United States Patent [19]

Lorenz

[11] 4,048,833

[45] Sept. 20, 1977

[54] GRIPPING ARRANGEMENT

[75] Inventor: Horst Lorenz, Solingen, Germany

[73] Assignee: Kieserling & Albrecht, Solingen, Germany

[21] Appl. No.: 641,188

[22] Filed: Dec. 16, 1975

[30] Foreign Application Priority Data

Dec. 19, 1974 Germany ..... 2460168

[51] Int. Cl.[2] ..... B21C 1/14

[52] U.S. Cl. ..... 72/290; 83/277; 226/112

[58] Field of Search ..... 72/290; 83/277; 226/112

[56] References Cited

U.S. PATENT DOCUMENTS

| | | | |
|---|---|---|---|
| 2,392,609 | 1/1946 | Newman | 226/112 X |
| 3,549,072 | 12/1970 | Ito | 226/112 |
| 3,583,268 | 6/1971 | Scribner | 226/112 X |
| 3,844,152 | 10/1974 | Peytavin | 226/112 X |
| 3,881,339 | 5/1975 | Mannell | 72/290 X |

*Primary Examiner*—Frank T. Yost
*Attorney, Agent, or Firm*—Michael J. Striker

[57] ABSTRACT

A gripping arrangement for longitudinally advancing elongated workpieces, particularly for use in a drawing bench, a stripping machine and the like, comprises a pair of supports which are mounted on guide rails for movement in paths which are parallel to one another and to the direction of advancement of the workpiece, and coextensive. Jaw elements are mounted on the supports for movement therewith and for displacement between closed positions in which they engage, and open positions in which they are disengaged from, the workpiece. The gripping arrangement is located downstream of a die and operates in such a manner that always at least one pair of jaw elements associated with one of the supports engages the workpiece and advances the same in a given direction, thus drawing the workpiece through the die. While one of the supports with its jaw elements draws the workpiece through the die, the other support with its jaw elements in their open positions returns to the upstream end of its path the one support and its associated closed pair of jaws. The jaw elements of each of the support extend beyond the support toward the path of movement of the other support, but the jaw elements of the two supports do not interfere with one another as long as at least one pair of the jaw elements is in the open position thereof. A drive for displacing the jaws between the positions thereof includes a movable member and a pair of links which are pivoted to the jaws and to the movable member. The two supports are independently driven into movement in their paths so that the speed and direction of movement of each support can be selected independently of the speed and direction of movement of the other support.

10 Claims, 2 Drawing Figures

GRIPPING ARRANGEMENT

BACKGROUND OF THE INVENTION

The present invention relates to a gripping arrangement in general, and more particularly to a gripping device for use in machines for treating elongated workpieces, such as draw benches, stripping machines and similar arrangements.

There are already known various gripping arrangements for use in drawing or stripping machines and, generally speaking, they include a plurality of jaw elements which sequentially close around the workpiece and advance the workpiece in a predetermined direction, thus drawing the workpiece through a die. Among the known gripping arrangements, there are already such in which two supports are guided on rails or similar guiding arrangements for reciprocation in the direction of advancement of the workpiece, which supports are equipped with jaw elements, such jaw elements being mounted on their respective supports for movement generally in the radial direction of the workpiece between a closed and an open position thereof so as to engage and disengage the workpiece.

Some of the important problems which have to be solved when drawing long or endless workpieces through a die or out of a treating machine are, on the one hand, to obtain high throughput of the drawing arrangement and of the gripping arrangement and, on the other hand, to obtain uniform drawing speed despite the fact that the drawing force is exercised upon the workpiece by one support and its associated jaw elements for part of the operating cycle, and by the other support and its associated jaw elements for another part of the cycle. A further requirement which must be satisfied in connection with each gripping or drawing arrangement is that it be simple, economical and reliable.

To solve the above problems and to satisfy the above requirements, it has been already proposed to provide a gripping arrangement for use in a drawing machine, which gripping or drawing arrangement includes only a single tensioning support which draws the workpiece through the die as it moves in one direction away from the die, whereas the tensioning support is returned to its initial position in the opposite direction at an increased speed in order to keep the intervening time periods between successive drawing operations to a minimum. It will be appreciated that this arrangement operates on an intermittent basis, which is not objectionable in some instances. Inasmuch as substantial forces are applied to and transmitted by the tensioning support to the workpiece being drawn, the tensioning support has usually substantial weight and, consequently, high inertia. The high inertia of the tensioning support determines the upper limit to the increase in the speed of return movement of the tensioning support. Thus, this type of an arrangement is not suited for many applications.

There are also already known many different constructions of gripping, tensioning and drawing arrangements which utilize caterpillar-like advancing arrangements in which the workpiece is gripped between jaws which are arranged on a pair of caterpillar-like conveyors which run at the same speed and also in the same direction in the region of engagement with the workpiece. It will be appreciated that this type of an arrangement is very complex and expensive, particularly because of the need for precise synchronization of the advancement of the two conveyors, and the need for providing the plurality of the gripping jaws on the two conveyors, which gripping jaws must be precisely machined to cooperate with one another, only less than a half of the gripping jaws being in engagement with the workpiece being drawn at any given moment.

In a further prior art construction, there is provided a drawing or gripping arrangement which includes two tensioning supports mounted for movement on guiding rails in such a manner that one of the tensioning supports is arranged behind the other tensioning support when viewed in the direction of advancement or drawing of the workpiece. Because of this successive arrangement of the two tensioning supports, each of the supports is capable of drawing the workpiece through a distance which approximately corresponds to half the length of the guiding rails, whereupon the other tensioning support takes over and the first tensioning support returns to its initial position, the same procedure being followed for the other tensioning support. This results in a drawing machine, or a gripping and drawing arrangement therefor, the guide rails of which are excessively long.

SUMMARY OF THE INVENTION

Accordingly, it is a general object of the present invention to avoid the disadvantages of the prior art.

More particularly, it is an object of the present invention to provide a gripping arrangement for advancing elongated workpieces longitudinally thereof which is capable of advancing the workpieces at a constant speed.

It is yet another object of the present invention to provide a gripping arrangement which is simple in construction and reliable in operation.

A concomitant object of the present invention is to provide a gripping arrangement for use in a drawing machine which draws the workpiece through a die at a constant speed and on a continuous basis. Still another object of the present invention is to provide a gripping arrangement including two supports which can move in opposite directions without interfering with one another.

In pursuance of these objects and others which will become apparent hereafter, one feature of the present invention resides, briefly stated, in a gripping arrangement for advancing elongated workpieces longitudinally thereof, in a combination which comprises elongated guide means; a pair of supports mounted on the guide means for movement longitudinally thereof in parallel and coextensive paths; jaw means mounted on each of the supports for movement therewith and for displacement between a closed position in which the jaw means engages a workpiece, and an open position in which the jaw means is disengaged from the workpiece; and means for sequentially operating the supports and the jaw means so that, at any given instant, at least one of the supports moves in an advancement direction with the jaw means in the closed position, followed by a return movement in an opposite direction with said jaw means in the open position.

According to a further concept of the present invention, the present invention resides, in a machine for treating elongated workpieces, such as a drawing bench, a stripping machine and the like, in a combination which comprises a die having an opening for passage of a workpiece therethrough in a predetermined direction; elongated guide means downstream of the die and parallel to the direction; a pair of supports mounted on the guide means for movement longitudinally thereof in parallel and coextensive paths; jaw means mounted on each of the supports for movement therewith and for displacement between open and closed positions; and means for sequentially operating the supports and the jaw means so that the jaw means of each respective support closes and engages the workpiece immediately downstream of the die and draws the workpiece through the die during the movement of the respective support in the direction, whereas the other respective support opens and disengages the workpiece upon reaching a downstream end of its path and conducts return movement opposite to said direction, and vice versa.

According to a currently preferred embodiment of the present invention, the jaw means of each of the supports includes a pair of jaw elements which substantially completely surround a portion of the workpiece when in the closed position thereof. In a currently preferred embodiment of the present invention, the jaw elements of a respective support extend beyond the support in direction toward the path of movement of the other support and, consequently, toward the workpiece which is located between the supports. When both pairs of the jaw elements, that is the jaw elements which are associated with both of the supports, are in their closed positions, which occurs when one of the pairs of jaw elements takes over the drawing function from the other pair of jaw elements, the free ends of the jaw elements point in opposite directions transversely of the elongation of the workpiece and also transversely of the paths of movement of the supports.

The jaw elements are so constructed as not to interfere with movement of each other or of the supports, the former when at least one pair of the jaw elements is in its open position, the latter under all circumstances. Thus, when one pair of jaw elements is in its open position, the supports and the jaw elements associated therewith can pass one another without interference.

Each of the supports has a separate drive so that the speed and the direction of movement of each of the supports can be controlled individually and independently of the speed and direction of movement of the other support. However, the movements of the two supports are so coordinated as to assure faultless continuous drawing of the workpiece through the die. In view of the independence of the speeds of movement of the two supports, not only can the returning support move at a quicker pace than the advancing or drawing support, but also both supports can move, for a limited period of time, in the same advancing directions, with the jaw elements closed around the workpiece, at the same or at different speeds whereby taking over of the workpiece by one pair of jaw elements from another pair of jaw elements is facilitated.

It is currently preferred to mount the jaw elements on their associated supports for pivoting, and to provide a drive for each pair of jaw elements, the drive having a moving element which is connected to the jaws of its associated pair by means of connecting links which are pivoted to the jaw elements and to the moving member, respectively. However, it is also proposed according to the present invention to construct the jaws as essentially L-shaped elements which are guided in the respective support for displacement in direction normal to the direction of advancement of the workpiece, each of the L-shaped elements having a portion which extends transversely of the workpiece and which can be moved toward and away from the workpiece.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DISCUSSION OF THE PREFERRED EMBODIMENTS

Figure 1:
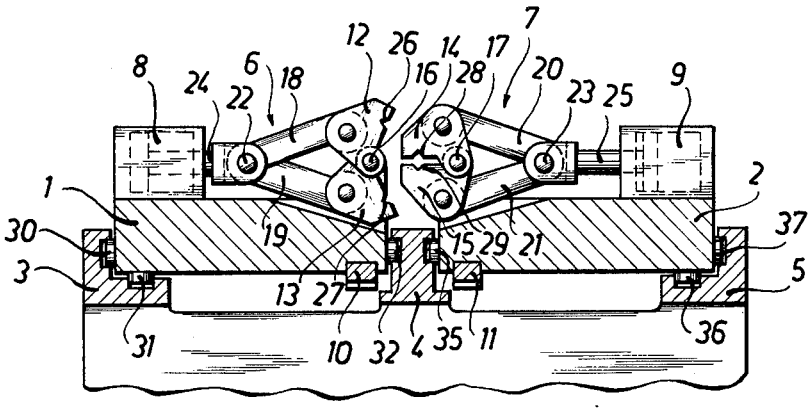
FIG. 1 is a partly sectioned end view of the gripping arrangement of the present invention when considered in direction of advancement of the workpiece.

Referring now to the drawings, and first to FIG. 1 thereof, it may be seen therein that the advancing and drawing gripping arrangement of the present invention includes two supports 1, 2 which are mounted on guide rails 3, 4 and 5 and each of which includes gripping units which are designated in toto with reference numerals 6 and 7. The two supports 1 and 2 are similar in construction to one another so as to be interchangeable with one another. The support 1 is equipped with the gripping unit 6, while the support 2 carries the gripping unit 7. The gripping units 6 and 7 are also one like the other so that there is no difference between the construction of the support 1, together with its accessories, from that of support 2 with the accessories thereof.

Cylinder-and-piston units 8 and 9 of conventional constructions are mounted on the supports 1 and 2, respectively, and they are connected with the gripping units 6 or 7. Reference numerals 10 and 11 designate toothed racks each of which is associated with one of the supports 1 and 2 and each of which constitutes part of a conventional drive, such as a rack and pinion drive, for the respective support 1 or 2.

Each of the gripping units 6 and 7 includes a pair of jaw elements 12 and 13 for the gripping unit 6, and 14 and 15 for the gripping unit 7. Each pair of the jaw elements 12, 13; 14, 15 is interconnected by means of pivots 16 or 17. Each pivot 16 or 17 is supported in bearings 43, 44 on the one hand, and 45, 46 on the other hand. The bearings 43, 44; 45, 46 are rigidly and stationarily connected with the respective supports 1 or 2. Connecting links 18, 19; 20, 21 are pivotably connected to the respective jaw elements 12, 13; 14, 15. The jaw elements 12, 13; 14, 15 have clamping depressions 26, 27; 28, 29, and the jaw elements are so constructed, and the links 18, 19; 20, 21 are so pivoted thereto, that the depressions 26, 27; 28, 29 are located at the free ends of the jaw elements 12, 13; 14, 15. In this manner, the clamping force is applied by the jaw elements 12, 13; 14, 15 at points which are outwardly spaced from the pivots 16, 17.

The two connecting links 18, 19; 20, 21 of each of the gripping units 6, 7 are pivotally connected to a piston rod 24, 25 of the respective cylinder-and-piston unit 8, 9 by means of pivot bolts 22 and 23, respectively. As a result of this above-discussed arrangement and configuration of the various elements constituting the gripping units 6 and 7, movement of the respective piston rod 24 or 25 in one direction results in closing of the jaw elements 12, 13; 14, 15, while movement of the piston rod 24 or 25 in the opposite direction results in opening of the jaw elements 12, 13; 14, 15.

Figure 2:
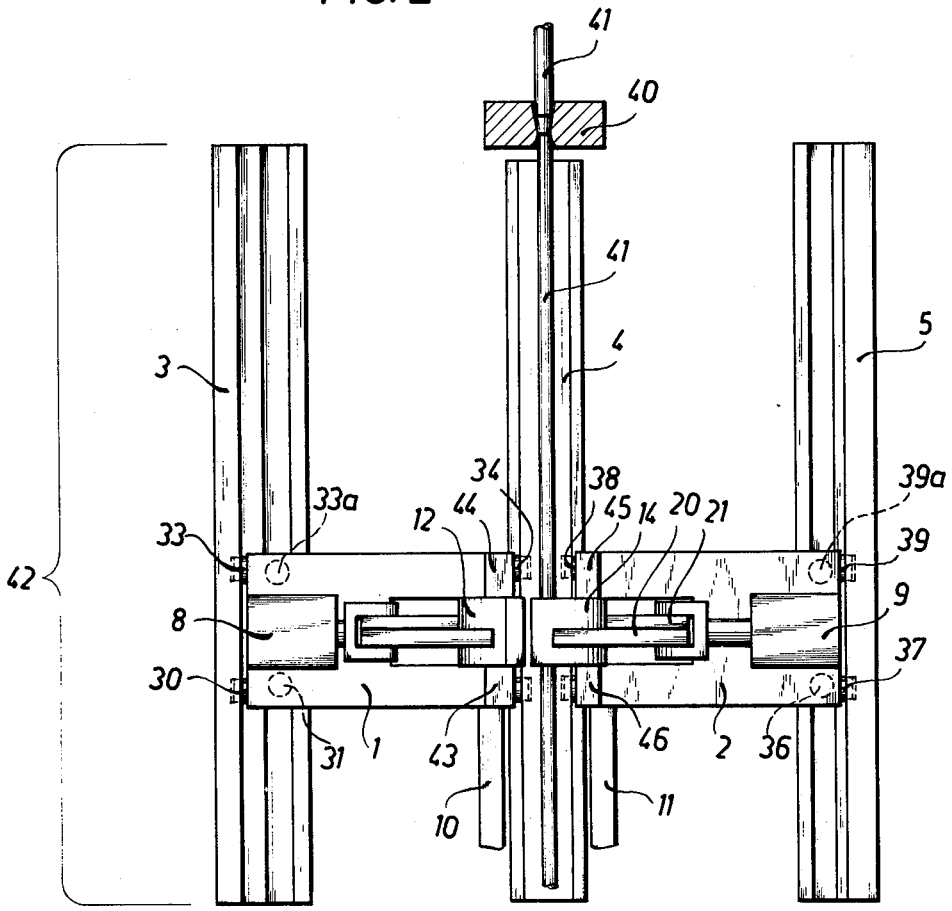
FIG. 2 is a top plan view of the arrangement of FIG. 1.

A comparison of FIGS. 1 and 2 will indicate that the supports 1 and 2 are equipped with guiding rollers 30, 31, 32, 33, 33*a*, 34; 35, 36, 37, 38, 39, 39*a*, which guide rollers are guided in guide recesses of the guide rails 3, 4, 5 for movement of the supports 1 and 2 in the advancement direction of the workpiece. The guide rails 3, 4 and 5 for each of the supports 1 and 2 extend over the entire advancement distance 42 of the machine in which the present arrangement is used, the guide rails 3, 4 and 5 being parallel with one another and also with a workpiece 41, as illustrated in FIG. 2.

FIG. 2 also shows that, at this particular stage of operation of the arrangement, the jaw elements 14 and 15 are closed around the workpiece 41 so that the support 2 draws the workpiece 41 through the die 40. On the other hand, the jaw elements 12 and 13 are in their open positions, and the support 1 is on its way toward the die 40. The two supports 1 and 2 pass each other without interference. Similarly, the open jaw elements 12 and 13 pass the closed jaw elements 14 and 15 without interfering with the movement thereof. This non-interference is particularly due to the fact that the depressions 26, 27; 28, 29 of the jaw elements 12, 13; 14, 15 are arranged at the free ends of the jaw elements 12, 13; 14, 15.

In view of the fact that each of the supports 1, 2 is equipped with its separate toothed rack 10 or 11 which forms a part of a separate, non-illustrated, conventional drive, the speeds of the supports 1 and 2 can be individually controlled, particularly during the transition period when one of the supports 1 and 2 approaches the end of the guide rails 3, 4 and 5 which is remote from the die 40 while the other support 1, 2 is located proximate to the die 40. During the transition phase of operation of the arrangement, both gripping units 6 and 7 engage the workpiece 41 for a short period of time. During such transition phase, the supports 1 and 2 and thus the gripping units 6 and 7 associated therewith may move either at the same speed, or at different speeds, in the advancement direction to facilitate taking over of the workpiece from one pair 12, 13 of jaw elements by another pair 14, 15 of jaw elements, or vice versa. This, of course, results in uniform drawing of the workpiece 41 through the die 40. Always when one of the supports 1 and 2 individually draws the workpiece 41 by its respective gripping unit 6 or 7, the other support 1, 2 moves at high speed in direction toward the die 40.

The present invention also contemplates, instead of pivotally mounting the jaw elements 12, 13; 14, 15 on the supports 1 and 2, to construct the jaws as generally L-shaped elements, and to mount the L-shaped elements on the respective supports 1 and 2 for movement transversely of the drawing direction of the workpiece 41. In this event, the L-shaped elements will move radially toward and away from the workpiece into and out of engagement therewith, and the open L-shaped elements will pass radially outwardly of the closed L-shaped elements.

It will be understood that each of the elements described above, or two or more together, may also find a useful application in other types of constructions differing from the types described above.

While the invention has been illustrated and described as embodied in a gripping arrangement used in a drawing machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A gripping arrangement for continuously advancing elongated workpieces longitudinally thereof in an advancement path, comprising, in combination, elongated guide means parallel to a section of the advancement path; a pair of supports each mounted on said guide means for reciprocatory movement along the same in a reciprocatory path that is parallel to, offset from, and coextensive with, the advancement path section and the reciprocatory path of the other support; means for reciprocating each of said supports in the respective reciprocatory path thereof in an advancement and a return direction, respectively, past the other support; at least a pair of jaws for each respective support; means for mounting each respective jaw pair on the respective support for displacement relative thereto only in a pivoting movement between a closed and an open position in which said respective jaw pair engages, and is disengaged from, a workpiece, respectively, and for joint reciprocation with said respective support, when in said closed position, in a first path having a path portion about the advancement path section in common with the first path of the other jaw pair, and, when in said open position, in a second path spaced from the advancement path section and from said common path portion; and means for so displacing said jaws of each respective pair between said positions thereof that at least one of said jaw pairs is always in said closed position thereof while moving with the respective support in said advancement direction for engaging and continuously advancing the workpiece, while each of said jaw pairs is in said open position thereof at least while moving with the respective support in said return direction past the other jaw pair for avoiding interference with the movement of the latter by moving in said second path that is outside said common path portion.

2. A combination as defined in claim 1, wherein said guide means includes elongated rails extending parallel to the advancement path.

3. A combination as defined in claim 2, wherein each of said supports includes a plurality of rollers in guiding engagement with said rails.

4. A combination as defined in claim 1, wherein said jaws of each of said supports extend beyond said reciprocatory path movement of the respective support toward the other support at least when in said closed position.

5. A combination as defined in claim 4, said means for displacing said jaw pairs between said positions thereof including a drive for each of said pairs of jaws and having a movable member, and connecting links pivoted to said jaw elements and to said movable member, respectively.

6. A combination as defined in claim 5, wherein said drive includes a cylinder-and-piston unit having one member stationary relative to the respective support, said movable member being movable with respect to said stationary member.

7. In a machine for treating elongated workpieces, such as a drawing bench, stripping machine and the like, a combination comprising a die having an opening for passage of a workpiece therethrough; and means for continuously advancing the workpiece in an advancement path through said opening of said die, including elongated guide means parallel to a section of the advancement path downstream of said die, a pair of supports each mounted on said guide means for reciprocatory movement along the same in a reciprocatory path that is parallel to, offset from, and coextensive with, the advancement path section and the reciprocatory path of the other support; means for reciprocating each of said supports in the reciprocatory path thereof in an advancement and a return direction, respectively, past the other support; at least a pair of jaws for each respective support; means for mounting each respective jaw pair on the respective support for displacement relative thereto only in a pivoting movement between a closed and an open position in which said respective jaw pair engages, and is disengaged from, the workpiece, respectively, and for joint reciprocation with said respective support, when in said closed position, in a first path having a path portion about the advancement path section in common with the first path of the other jaw pair, and, when in said open position, in a second path spaced from the advancement path section and from said common path portion; and means for so displacing said jaws of each respective pair between said positions thereof that at least one of said jaw pairs is always in said closed position thereof while moving with the respective support in said advancement direction for engaging the workpiece and continuously advancing the same through said opening of said die, while each of said jaw pairs is in said open position thereof at least while moving with the respective support in said return direction past the other jaw pair for avoiding interference with the movement of the latter by moving in said second path that is outside said common path portion.

8. A combination as defined in claim 7, wherein said advancing means includes means for independently moving said supports in said advancing and return directions.

9. A combination as defined in claim 8, wherein both of said supports move in said advancing direction with said jaw pairs thereof in said closed positions during the initial movement of a respective support away from the upstream end of its reciprocatory path.

10. A combination as defined in claim 9, wherein said supports move at different speeds in said advancing direction during said initial movement.

* * * * *